United States Patent [19]

Isella

[11] 4,332,072

[45] Jun. 1, 1982

[54] METHOD AND DEVICE FOR SPACING CONTINUOUSLY MANUFACTURED ZIP FASTENERS IN WHICH THE CONNECTION ELEMENTS ARE CONSTITUTED BY A MONOFILAMENT OF MEANDER OR SPIRAL FORM

[75] Inventor: Giuseppe Isella, San Damiano, Italy

[73] Assignee: Brevetti Motta s.a.s, Milan, Italy

[21] Appl. No.: 123,430

[22] Filed: Feb. 21, 1980

[30] Foreign Application Priority Data

Feb. 27, 1979 [IT] Italy ..... 20593 A/79

[51] Int. Cl.[3] ..... B29D 5/00; A41H 37/06; B23P 19/04

[52] U.S. Cl. ..... 29/408; 29/410; 29/770; 29/766; 83/921

[58] Field of Search ..... 29/408, 410, 770, 766, 29/564.3, 426.3, 426.1; 83/921

[56] References Cited

U.S. PATENT DOCUMENTS

| | | | |
|---|---|---|---|
| 3,054,168 | 9/1962 | Ruhrmann | 29/410 |
| 3,225,430 | 12/1965 | Fasciano | 29/766 |
| 3,711,930 | 1/1973 | Potin | 29/770 |
| 3,763,546 | 10/1973 | Perlmann | 29/770 |
| 4,206,544 | 6/1980 | Shimai | 29/770 |
| 4,206,669 | 6/1980 | Fisher et al. | 29/408 |

FOREIGN PATENT DOCUMENTS

| | | | |
|---|---|---|---|
| 788376 | 1/1958 | United Kingdom | 29/410 |

*Primary Examiner*—Daniel C. Crane

*Attorney, Agent, or Firm*—Cushman, Darby & Cushman

[57] ABSTRACT

The invention relates to a method and a device for spacing continuously manufactured zip fasteners having connection elements constituted by a monofilament of meander or spiral form rigid with the edges of supporting tapes. The method consists in removing by cutting firstly the central part of the connection elements of the two coupled tapes, and then removing the open lateral loops of the meanders or spirals by passing under tension the zone of the coupled tapes from which the central part of the connection elements has been removed, over a deviation member in such a manner that the tapes partly wrap said deviation member.

11 Claims, 10 Drawing Figures

11
15b
15c
13a
13
14a
13b
15
15a
14
14a
12b
12a
12
14b
14c
10

20
13a
12a
14c
14c
14b
14b
15c
III
III
15c
11
15b
15b
14a
15a
14a
15a
10

15a
15c
15b
13a
11
13b
15b
15c
15b
15c
15b
15c
15a
15

METHOD AND DEVICE FOR SPACING CONTINUOUSLY MANUFACTURED ZIP FASTENERS IN WHICH THE CONNECTION ELEMENTS ARE CONSTITUTED BY A MONOFILAMENT OF MEANDER OR SPIRAL FORM

This invention relates to a method and device for spacing continuously manufactured zip fasteners in which the connection elements are constituted by a monofilament of meander or spiral form which is rigid with the edges of support tapes.

Recently, various types of zip fastener have been developed constituted by two support tapes formed from a fabric and comprising in one of their edges a monofilament of meander or spiral form which forms the row of connection elements designed to be brought into mutual engagement or disengaged by means of a slider. The monofilament of meander or spiral form can be made rigid with the edge of the relative support tape either by weaving during the tape manufacture, or by being sewn on to said edge. The meander (or spiral) is normally formed from a synthetic monofilament which at regular distances can comprise deformations forming the teeth or actual connection elements.

The support tapes with their rows of connection elements are continuously manufactured and coupled together to form long lengths from which the individual zip fasteners of the required length can be cut.

In practice, a zip fastener must have a certain portion free from teeth or connection elements at the two ends of the pair of tapes, and these elements must therefore be removed over a certain length from the pair of continuous tapes between one individual zip fastener and the next. This removal of the teeth is normally known as the "spacing operation".

It would be possible to space the individual zip fasteners during the manufacture of the continuous tapes, but this would have the drawback that the individual zip fasteners would then be prepared in predetermined lengths, whereas it is well known that they are used in the most varied sizes.

Up to the present time, the spacing of zip fasteners of the aforesaid type has been carried out using a blade-shaped punch passed between the two coupled support tapes, so as to remove the central part of the teeth or connection elements, leaving the side loops of the meanders or spirals attached to the edges. To remove these parts connected or sewn to the tape edges, it has been necessary to use constructionally complicated rotating devices with the risk of damaging the support tapes by cutting or tearing their threads, whereas they do not ensure complete removal of the pieces of monofilament.

The object of the present invention is therefore to obviate these drawbacks, and to provide a very simple method and device able to space zip fasteners in which the connection elements are formed by monofilaments of meander of spiral form, without any risk of damaging the support tapes.

This object is attained according to the invention by a first operation, carried out in conventional manner, for removing the central part of the connection elements of the two continuous coupled tapes by cutting over the required spacing length, and then passing under tension that zone of the coupled tapes in extended form from which the central part of the connection elements has previously been removed, over at least one deviation member in such a manner that this latter is partly wrapped by the tapes.

This deviation member can be a roller freely rotatable about its axis, but can also consist of a fixed member such as a rod, the edge of a blade or the like.

When the connection elements are fixed asymmetrically on one side of the edge of the support tapes, it can be sufficient to pass the coupled tapes over a single deviation member, with these sides of the tapes opposite the ones to which the connection elements are fixed being in contact with the surface of the deviation member.

On the other hand, when the monofilament of meander or spiral form is connected to the edge of each tape symmetrically about the plane of the tape, the coupled tapes must be passed over at least two parallel deviation members so that the tapes follow a zig-zag path.

The effect obtained by the passage or passages of the tapes over the deviation members can be explained in the following manner. This monofilament of meander or spiral form is retained on the edge of the relative support plate in a substantially erect position, i.e. with the meander loops or the spiral turns which make up the actual connection elements being disposed substantially perpendicular to the plane of the tape, by means of threads of the fabric forming the edge of the tape or by means of sewing threads which lie in a plane parallel to the tape plane. Now these threads, which after the cutting of the central part of the connection elements continue to retain the open lateral loops on the edges of the two tapes, these loops now being in the form of single pieces of monofilament, undergo a certain resilient tension as the tapes pass over a deviation member and partly wrap about it, this tension deriving from the difference in the radius of that part of the tape edges directly in contact with the surface of the deviation member and the most outer part containing said threads, and thus press radially in a direction towards the surface of the deviation member. This pressure urges said open lateral loops in the form of pieces of monofilament to become released and to escape laterally from the grip of said threads.

It is apparent that if said open lateral loops and the relative threads which retain them on the tape edges are on a single side of the tape plane, it can be sufficient to pass over a single deviation member with the tapes in contact with the surface of the member and the part containing said threads on the outside. However, if the open lateral loops and the relative threads which retain them are on both sides of the tape plane, a zig-zag passage is necessary over at least one pair of deviation members so that the open loops and their relative retaining threads which are disposed on one side of the tape plane and the open loops and their retaining threads disposed on the other side of the tape plane become positioned alternately on the outside, i.e. over a greater radius.

The tension which the threads retaining the lateral loops undergo during passage over the deviation member, and thus the pressure which these exert on the pieces of monofilament to be removed, depends on the one hand on the distance of the plane containing three threads from the tape plane, and on the other hand on the radius of curvature which the tape undergoes in passing over the deviation member. The first of these quantities is a characteristic of the zip fastener and is a function of the height of its connection elements. The second quantity can be suitably chosen in performing the method according to the invention.

It is clear that the ratio of the length of the external wrapping arc, i.e. the arc described by said threads which retain the pieces of monofilament, to the length of the internal wrapping arc, i.e. the arc described by the tapes in contact with the surface of the deviation member, is greater the smaller the radius of curvature resulting from the deviation member. Consequently, the pressure exerted by said threads on the pieces of monofilament to be removed is greater the smaller the radius of curvature resulting from the deviation member.

However, when using rollers or rods as the deviation members, certain limits must be observed in choosing the radius of said deviation rollers. For constructional reasons, the radius of the deviation rollers cannot be too small. This is because the rollers must be adequately supported, possibly freely rotatable about their own axes, and must not undergo inadmissible bending during passage of the coupled tapes of the zip fastener over them under tension. On the other hand, as stated, the radius of the rollers must not be too large otherwise a sufficient pressure to cause the pieces of monofilament to escape cannot be obtained. This pressure obviously also depends on the method of connecting and binding the monofilament of meander or spiral form to the support tape.

In practice, good results have been obtained with deviation rollers having a radius approximately equal to the height of the teeth or connection elements of the zip fastener.

In order to ensure removal of the pieces of monofilament with absolute reliability, the method according to the invention can be carried out by passing the coupled tapes zig-zag over more than one or more than two deviation members respectively.

The passage speed is not critical for the result attained by the method according to the invention, and the method can be carried out during the transfer of the coupled continuous tapes to other operations, provided it is preceded by the cutting of the central parts of the connection elements in the spacing zones concerned.

The device for carrying out the method according to the invention is extremely simple. Besides the conventional blade-shaped punch, it comprises at least one deviation member having a length at least equal to the total width of two support tapes when coupled by the relative connection elements, means for guiding these coupled tapes in such a manner as to keep them in contact with part of the surface of the deviation member, and traction means acting on the coupled tapes in order to make them slide in contact with said part of the surface of the deviation member.

If the device comprises a plurality of deviation members, these are disposed parallel to each other in order to determine a zig-zag path for the coupled tapes, such that these become located alternately with one of their sides in contact with the surface part of one deviation member, and then with their opposite side in contact with the surface part of the next deviation member. If the deviation members are in the form of rotatable rollers, these rollers are disposed with their axes parallel, and are supported so as to be able to rotate freely about their axes.

The invention is described hereinafter with reference to the accompanying drawings which illustrate some applications thereof, by way of example, and in which.

Figure 1:
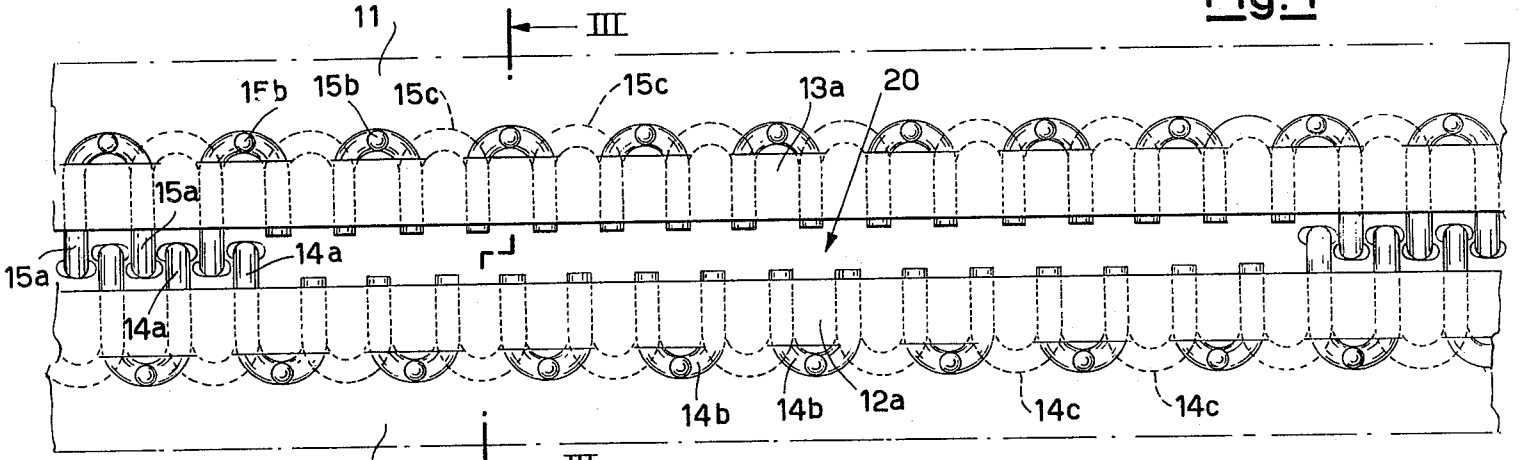
FIG. 1 is a plan view of two coupled tapes of a zip fastener, the connection elements of which are constituted by a U-bent meander form monofilament fastened into the tubular edge of the respective tape, with a spacing zone in which the central parts of the connection elements have already been removed.
Figure 10:
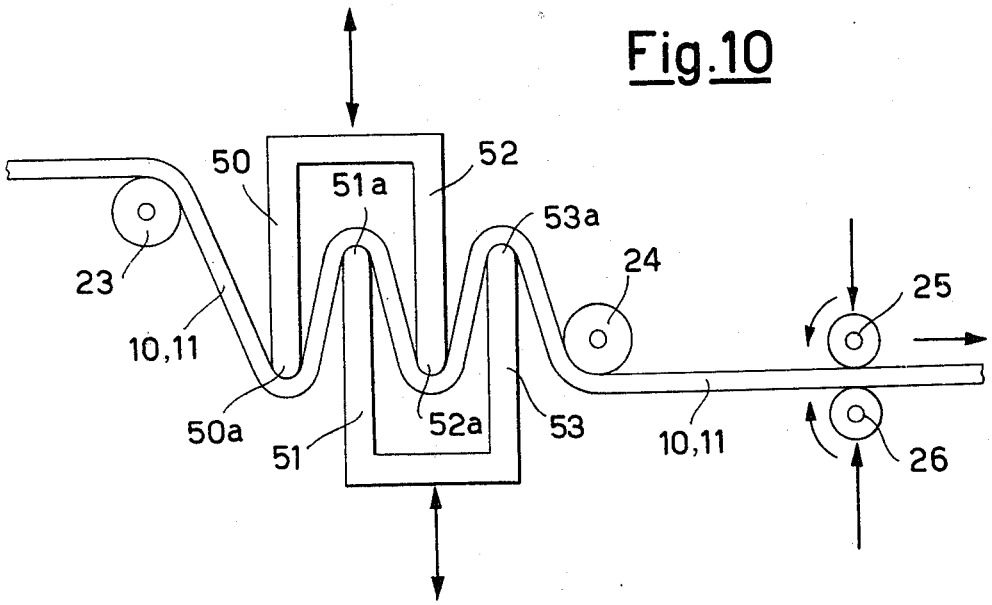
Figure 8:
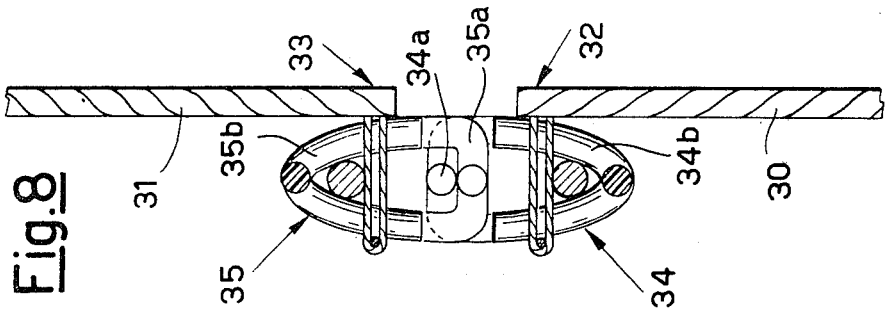
Figure 6:
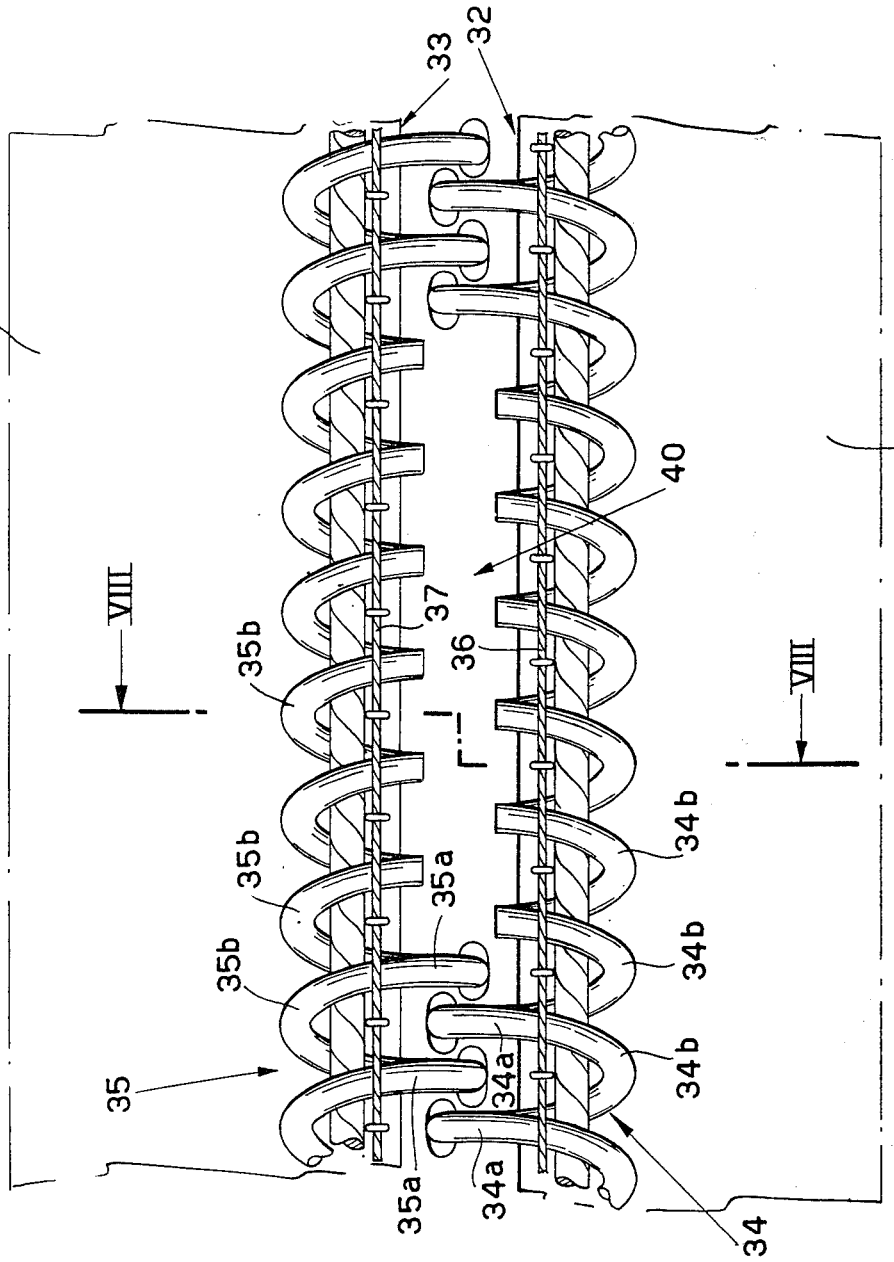
Figure 7:
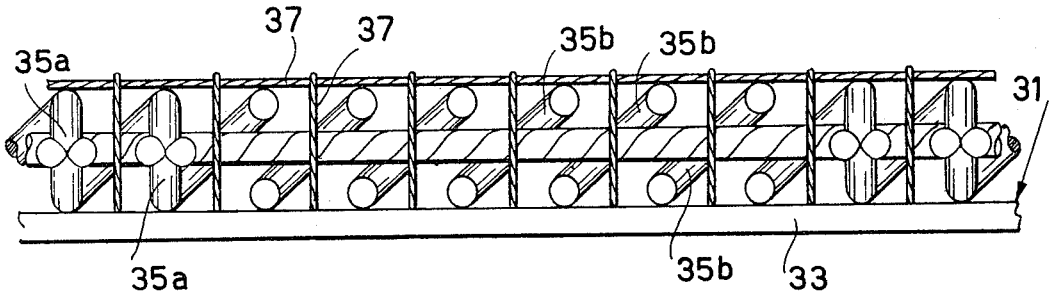
Figure 9:
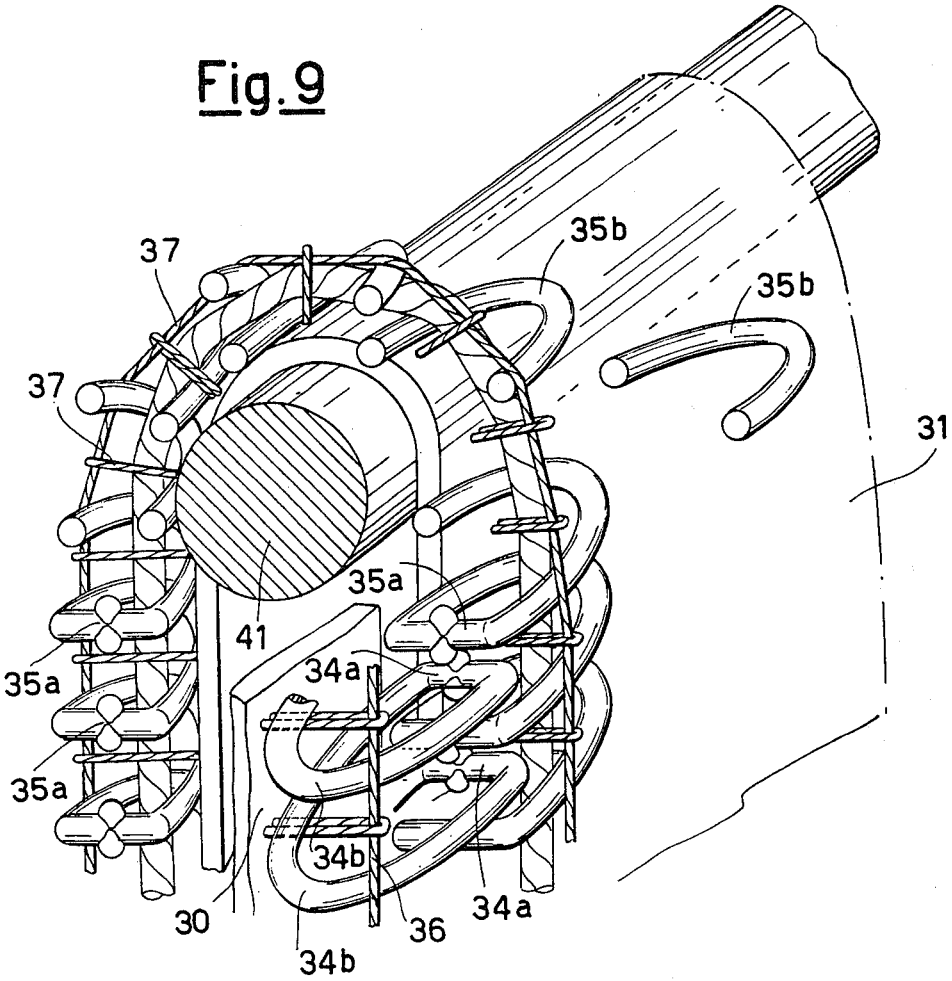

FIG. 6, as in FIG. 1, shows the two coupled tapes of a zip fastener, the connection elements of which are constituted by a monofilament of spiral form sewn on to the edge of the respective tape, and comprising a spacing zone;

FIG. 7 is a side view of only one of the two tapes of FIG. 6 from the connection element side;

FIG. 8 is a cross-section on the line VIII—VIII of FIG. 6;

FIG. 9 shows the passage of the two tapes of FIGS. 6 to 8 over a deviation roller; and FIG. 10 is a diagrammatic view of a further embodiment of the device according to the invention.

Figure 3:
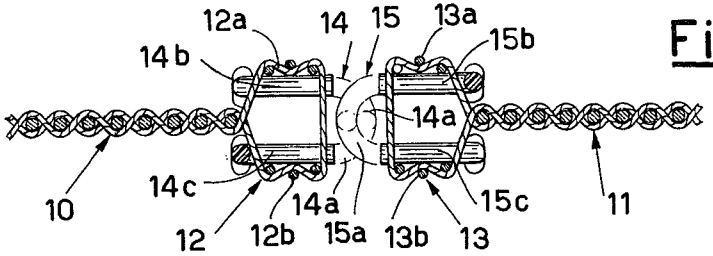
FIG. 3 is a cross-section on the line III—III of FIG. 1.
Figure 2:
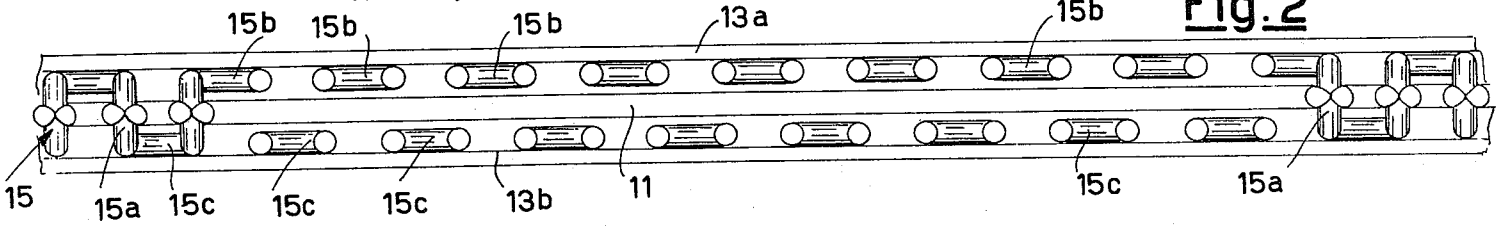
FIG. 2 is a side view of only one of the two tapes of FIG. 1, from the connection element side.

With reference to FIGS. 1 to 3, these show a zip fastener constituted by two support tapes indicated by 10 and 11, these tapes being formed from a fabric having a tubular edge 12 and 13 respectively, into which the U-shaped meander form monofilaments 14 and 15 respectively are joined by weaving. In particular, the edge 12, 13 of each tape 10, 11 is in the form of two layers of fabric 12*a*, 12*b* and 13*a*, 13*b* respectively, which partly cover the meander form monofilaments 14 and 15 respectively.

Each U-bent meander form monofilament comprises U-shaped loops 14*a* and 15*a* respectively, disposed in parallel planes perpendicular to the plane of the relative support plate 10 and 11 respectively, said loops constituting the actual connection elements of the zip fastener, together with lateral U-shaped loops 14*b*, 14*c* and 15*b*, 15*c* respectively, disposed in planes parallel to the plane of the relative support tape above and below this latter plane respectively.

The connection elements (loops 14*a*, 15*a*) are therefore in a substantially erect position on the edges of the respective tapes 10, 11, and the height of these elements constitutes a characteristic quantity of the zip fastener. This height can vary within wide limits according to the use of the zip fastener.

In order to space one zip fastener from the next, the central part of the coupled connection elements of two support tapes is firstly removed in known manner by cutting over the required length of the spacing zone. In FIG. 1 this spacing zone is indicated by 20. It can be clearly seen that after this cutting and removal of the central parts of the connection elements, i.e. of the U-shaped loops 14*a* and 15*a*, the open lateral U-shaped loops 14*b*, 14*c* and 15*b*, 15*c* respectively remain connected to the tape edges 12 and 13, these loops being retained by the fabric layers 12*a*, 12*b* and 13*a*, 13*b* of the edges.

The object of the method and device according to the invention is to reliably remove these open lateral loops in the form of monofilament pieces without any danger of damaging the edges of the support tapes.

Figure 4:
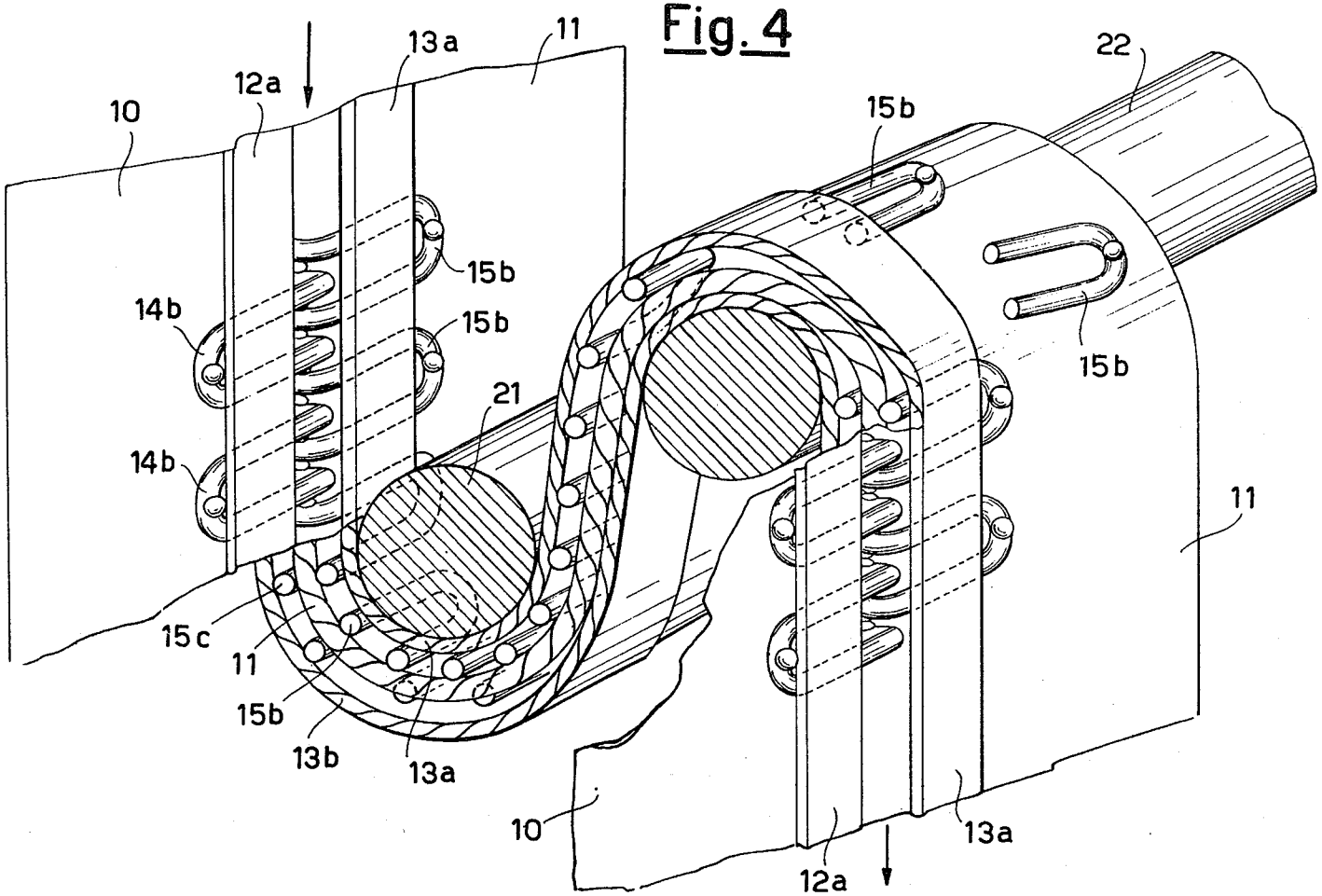
FIG. 4 shows the passage of the two tapes of the preceding figures over two deviation rollers.
Figure 5:
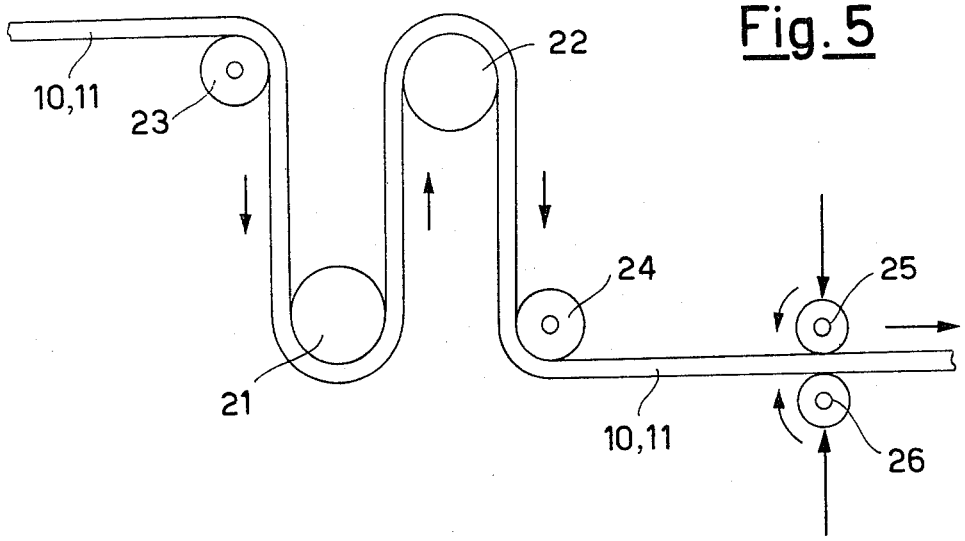
FIG. 5 is a diagrammatic view of a device comprising the two deviation rollers of FIG. 4.

FIGS. 4 and 5 diagrammatically illustrate one embodiment of the device according to the invention for attaining this object.

In the case considered, the device consists substantially of at least one pair of rollers 21, 22, disposed with their axes parallel in such a manner as to form a zig-zag path. These rollers can be either fixed or be freely rotatable about their own axes. The supports for these rollers are not shown, and can consist of normal rolling bearings disposed at the roller ends.

The two continuous tapes 10, 11 coupled together by means of the connection elements 14*a*, 15*a* are guided by rollers 23, 24 (see FIG. 5) such that they pass around each deviation roller 21 and 22 over an arc of about 180°. Traction means, for example constituted by a pair of rollers 25 and 26 driven to rotate in the direction of the arrows and pressed one against the other, drive the two tapes 10, 11 in the direction of the arrow indicated in FIGS. 4 and 5, and keep them under tension.

As can be seen in FIG. 4, the layers 12*a* and 13*a* of the edges of the two tapes on the first roller 21 are on the inside, i.e. in contact with the roller surface, whereas the layers 12*b* and 13*b* are on the outside, and this situation is reversed on the second roller 22. Each time, the outer layers become more under tension relative to the inner layers as they have to describe an arc of greater radius, and thus exert a radial pressure towards the surface of the relative deviation roller. The result of this pressure to which the open lateral loops 14*b*, 15*b* and 14*c*, 15*c* are subjected is that these loops or pieces of monofilament are urged to free themselves from the layers of fabric which retain them, and to escape laterally from their grip. In particular, with reference to FIG. 4, the open lateral loops 14*c* and 15*c* become expelled at the deviation roller 21, whereas the open lateral loops 14*b* and 14*b*, of the spacing zone become expelled at the deviation roller 22. The double passage over two deviation rollers 21, 22 is necessary because of the symmetrical arrangement of the U-bent meander form monofilaments about the plane of the support tapes. It is clear that the pieces of monofilament escape laterally outwards from the central zone of the zip fastener, i.e. from left to right, as shown in FIG. 4.

FIGS. 6 to 8 show another type of zip fastener in which each support tape 30, 31 carries at one of its edges 32, 33 a row of connection elements formed from a spirally wound monofilament 34 and 35 respectively. Each spirally wound monofilament comprises U-shaped loops 34*a* and 35*a* respectively, disposed in parallel planes perpendicular to the plane of the relative tape 30, 31, said loops constituting the actual connection elements, and lateral loops 34*b* and 35*b* respectively, which are fixed on to the edge of the relative tape by stitching indicated by 36 and 37 respectively.

The connection elements (loops 34*a*, 35*a*) are in an erect position on the edges of the respective tapes, whereas the lateral loops 34*b*, 35*b* are inclined to the tape planes. The loops 34*a*, 34*b* and 35*a*, 35*b* together form the turns of the spirals 34 and 35 respectively. It can be seen from the drawing that these spirals are applied asymmetrically to only one side of the respective support tapes 30, 31.

Spacing is again carried out in two stages in this case.

The central part of the actual connection elements (loops 34*a*, 35*a*) is firstly removed by means of a blade-shaped punch, and this zone is indicated in FIG. 6 by the reference numeral 40.

The tapes 30, 31 coupled by the connection elements 34*a*, 35*a* are then guided, in an extended form, over a deviation roller 41 (FIG. 9) so that they wrap this roller over an arc of about 180°. The support tapes 30, 31 are in contact with the surface of the roller 41, while the stitching threads 36, 37 have to describe an arc of greater radius, and are therefore subjected to a greater tension because of which they exert a pressure on the open lateral loops 34*b*, 35*b* in the spacing zone 40 such as to cause them to escape laterally. The concept on which the method according to the invention is based is therefore the same as in the first described case.

The tapes can obviously be made to follow a zig-zag path over more than one deviation roller for greater reliability, even in the case of a zip fastener comprising connection elements applied asymmetrically.

In the two embodiments heretofore described, rollers are used as the deviation members, and these can be either stationary or rotatable about their axes. However, other rotatable or fixed deviation members can be used. It is not necessary for the rollers to have a circular profile, and instead they can have a polygonal cross-section.

It is also possible to use blades of which the corners or free edges form the deviation members.

FIG. 10 indicates diagrammatically a device of this nature. In this case, two groups of blades 50, 52 and 51, 53 are provided, their edges 50*a*, 52*a* and 51*a*, 53*a* constituting the deviation members. As can be seen in FIG. 10, a deviation member of a group in the form of a comb (with two teeth in the case considered) is disposed at any required time between two deviation members of the second group, also in the form of a comb. The double arrows indicated in FIG. 10 show that the two combs can be moved towards or away from each other, preferably in an adjustable manner, in order to vary the mutual penetration of the blades 50, 52 of one group and the blades 51, 53 of the other group. It is therefore possible to vary the speed of the zig-zag path of the coupled tapes 10, 11 according to the degree of mutual penetration. The insertion of the tapes 10, 11 between the teeth can be facilitated by completely withdrawing the two combs from each other. Guide means 23, 24 and traction means 25, 26 for the coupled tapes are again provided in this case.

Such an arrangement can obviously also be used when the deviation members are in the form of rotatable rollers, in which case the rollers can be supported at the edges of the teeth of the two combs.

Each of said groups can also comprise more than two deviation rollers, according to requirements.

The extreme simplicity of the method and device according to the invention are apparent from the aforegoing description, the device surprisingly and unexpectedly attaining its object in a completely satisfactory manner, and having the further advantage of not using tools which could damage the fabric of the support tapes.

I claim:

1. A method for spacing continuously manufactured zip fasteners in which the connection elements are constituted by a monofilament of meander or spiral form rigid with the edges of support tapes, comprising removing the central part of the connection elements of the two continuous coupled tapes by cutting over the required spacing length, and then removing the open lateral loops of the meanders or spirals by longitudinally passing under tension that zone of the coupled tapes in extended form from which the central part of the connection elements has previously been removed, over at least one deviation member in such a manner that the tapes partly wrap around said deviation member with the result that the open lateral loops are urged laterally outwardly and are expelled from the tapes, said tension being of such a magnitude that material of the coupled tapes is the sole means for causing said loops to be expelled.

2. A method as claimed in claim 1 for application to zip fasteners in which the connection elements constituted by a monofilament of meander or spiral form are fitted asymmetrically on one side of the support tapes, wherein the coupled tapes are passed over at least one deviation member, with that side of the tapes opposite the side carrying the monofilament adhering to said deviation member.

3. A method as claimed in claim 1 for application to zip fasteners in which the connection elements constituted by a monofilament of meander or spiral form are fitted symmetrically about the plane of the tapes, wherein the coupled tapes are passed in a zig-zag path over at least one pair of deviation members.

4. A device for spacing a zip fastener of the kind comprising two support tapes coupled together by connection elements in the form of monofilaments of meander or spiral form rigid with the edges of the support tapes, said device comprising a blade-shaped punch for removing the central part of the connection elements, and means for removing the open lateral loops, said means including at least one deviation member of length at least equal to the total width of the two support tapes coupled by the relative connection elements, guide means for the coupled tapes to keep them in contact with part of the surface of the deviation member, said traction means acting on the coupled tapes to make them move longitudinally under tension in contact with said part of the surface of the deviation member so that the tapes partly wrap around the deviation member with the result that the open lateral loops are expelled laterally from the tapes, said traction means applying said tension at such a magnitude that the material of the coupled tapes is the sole means for causing the loops to be expelled.

5. A device as claimed in claim 4, comprising a plurality of deviation members disposed parallel to each other in such a manner as to determine a zig-zag path for the coupled tapes such that, alternately, one side of the tapes comes into contact with the part of the surface of one deviation member, and then the opposite side of the tapes comes into contact with the part of the surface of the next deviation member.

6. A device as claimed in claim 4, wherein the deviation members are constituted by rollers disposed with their axes parallel and supported so that they can rotate freely about their axes.

7. A device as claimed in claim 4, wherein the deviation members are fixed.

8. A device as claimed in claim 7, wherein the deviation members are constituted by the free edges of blades.

9. A device as claimed in claim 5, comprising two groups of deviation members, wherein a member pertaining to one group is disposed at any required time between two members pertaining to the second group.

10. A device as claimed in claim 9, wherein the two groups of deviation members can be moved towards and away from each other.

11. A device as claimed in claim 9, wherein each of said groups is in the form of a comb, the teeth of which are formed by blades, the edges of said blades constituting the deviation members.

* * * * *